United States Patent [19]

Jensfelt et al.

[11] 4,388,110

[45] Jun. 14, 1983

[54] METHOD FOR RECOVERING THE METAL CONTENT OF COMPLEX SULPHIDIC METAL RAW MATERIALS

[75] Inventors: Torsten E. Jensfelt, Stocksund; Stig A. Petersson, Skelleftehamn, both of Sweden

[73] Assignee: Boliden Aktiebolag, Stockholm, Sweden

[21] Appl. No.: 322,685

[22] Filed: Nov. 18, 1981

[30] Foreign Application Priority Data

Dec. 1, 1980 [SE] Sweden ..... 8008426

[51] Int. Cl.[3] ..... C22B 1/07

[52] U.S. Cl. ..... 75/21; 75/7; 75/23; 75/74

[58] Field of Search ..... 75/21, 23, 7, 74

[56] References Cited

U.S. PATENT DOCUMENTS

| | | | |
|---|---|---|---|
| 3,663,207 | 5/1972 | Themelis | 75/27 |
| 3,674,463 | 7/1972 | Yanopoulos | 75/72 |
| 3,790,366 | 2/1974 | Bryk | 75/23 |
| 3,847,595 | 11/1974 | Liang | 75/77 |
| 3,892,560 | 7/1975 | Nermes | 75/23 |
| 3,941,587 | 3/1976 | Queneau | 75/77 |
| 4,032,327 | 6/1977 | Donaldson | 75/72 |
| 4,087,274 | 5/1978 | Edenwall | 75/1 R |
| 4,266,971 | 5/1981 | Schwartz | 75/21 |

FOREIGN PATENT DOCUMENTS

| | | | |
|---|---|---|---|
| WO79/00058 | 2/1979 | PCT Int'l Appl. | 75/23 |

*Primary Examiner*—P. D. Rosenberg

*Attorney, Agent, or Firm*—Stevens, Davis, Miller & Mosher

[57] ABSTRACT

The metal content of complex sulphidic metal raw material is recovered therefrom by means of an autogenous flame-smelting process, preferably carried out in a vortex, with an oxygen-containing gas. The raw materials are smelted in a furnace in the presence of an excess of oxygen and together with an addition of an acid slag former, such as silica, to form a melt which is rich in metal-oxide silicate and poor in sulphur. Any metal phase formed in the furnace is separated from the silicate phase, and non-iron metals present in the silicate phase are recovered therefrom by selective reduction.

7 Claims, 1 Drawing Figure

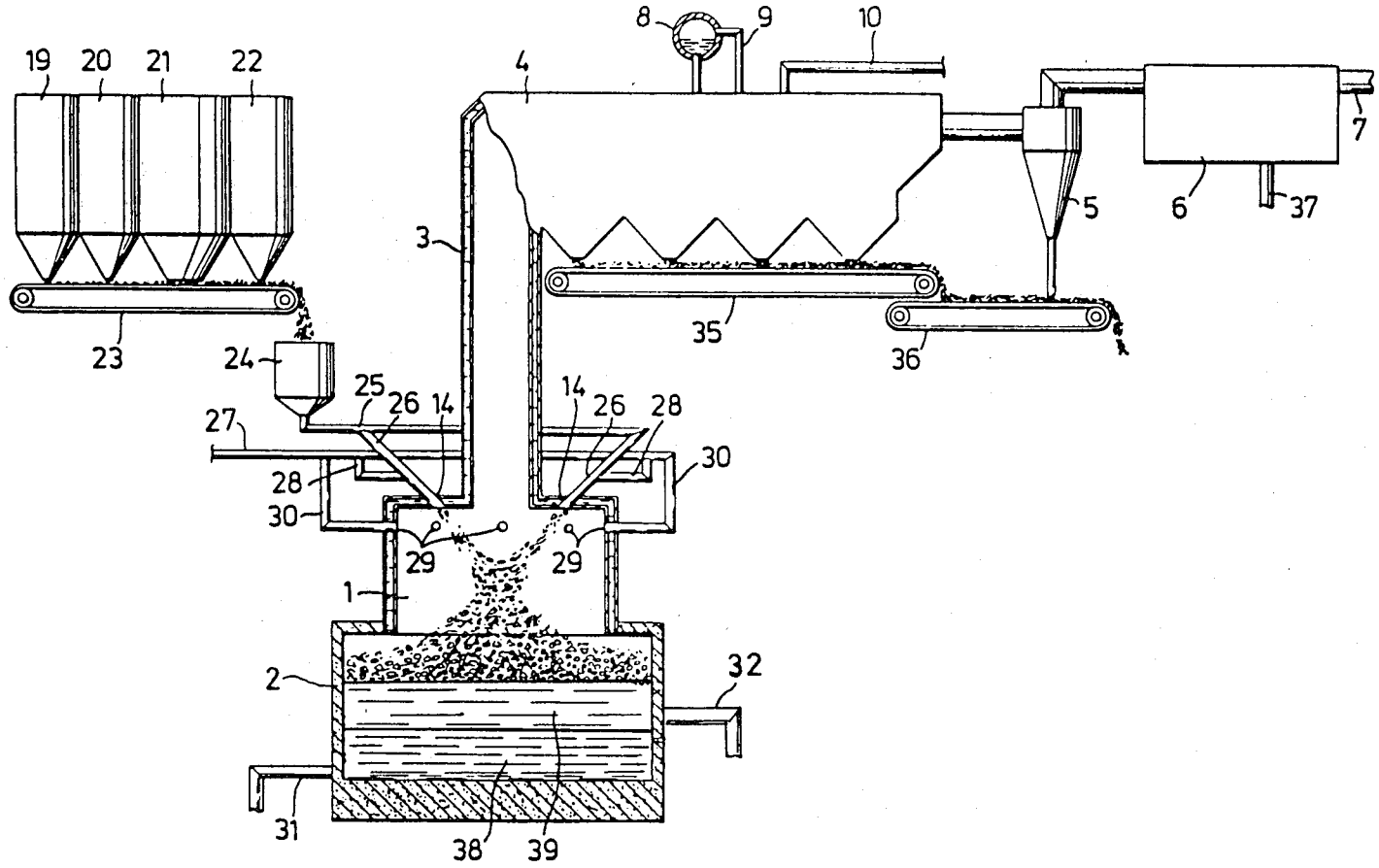
7
37
6
5
36
10
9
8
35
4
3
30
28
26
14
29
32
39
38
1
2
31
25
24
27
22
21
20
19
23

METHOD FOR RECOVERING THE METAL CONTENT OF COMPLEX SULPHIDIC METAL RAW MATERIALS

The invention relates to a method for recovering the metal content of complex sulphidic metal raw materials by autogenous flame smelting with an oxygen-containing gas. In particular, the method relates to the recovery of the metal content of sulphide concentrates which contain two or more of the metals lead, zinc, copper and nickel, and which may also contain noble metals and iron.

The autogenous flame-smelting of metal sulphide with an oxygen-containing carrier gas is a well known stage in the process of producing metal. The first patent applications in this field were filed at the end of the 19th Century. Thus a so-called pyrite smelting process was already described in U.S. Pat. No. 860,512, and this patent was followed at the beginning of the 20th Century by several applications relating to the flame-smelting process and proposed by an American named Freeman, see for example U.S. Pat. No. 1,812,397. In later times the flame-smelting process was utilized and developed by the Finnish Company Outokumpu, as evidenced, for example, in U.S. Pat. Nos. 2,506,577, 3,306,708, 3,790,366, 3,948,369, and 4,088,310. In the Outokumpu-process a sulphide material, in the form of a pyrite or non-iron metal concentrate, was smelted in a vertical shaft in concurrent with an oxygen-containing gas, by the action of the heat formed in the partial combustion of its sulphide-sulphur content, to form sulphur dioxide, slag and a sulphide melt, possibly also a metal melt. The Outokumpu-process can be applied to pure or complex sulphide concentrates containing, for example, copper, nickel, cobalt, zinc, lead and tin. The disadvantages with the Outokumpu-process, which disadvantages still remain, are primarily connected with the fact that the flame-smelting process is carried out in concurrent, which creates difficultly solved problems with respect to heat economy and the lining of the smelting shaft. Further, problems occur because the flame-smelted and roasted material and the roasting gas, which is rich in sulphur dioxide, accompany each other through the smelting process, thereby restricting the possibilities of obtaining a molten product poor in sulphur, and therewith also restricting the possibilities of selectively recovering metals from complex metal sulphide concentrates. The so-called Worcra process for the direct production of such metals as copper, nickel and lead from sulphide ores, also incorporates a flame-smelting stage as part of the process. The process, which is more clearly described in U.S. Pat. No. 3,326,671, is particularly complicated, however, both metallurgically and from the aspect of the apparatus used, and cannot yet be utilized on a commercial scale, even though 17 years have passed since the original patent application was filed.

Flame smelting can be carried out in both stationary and rotary furnaces, e.g., of the Kaldo-type, as illustrated, for example, in our earlier patent specifications SE,B, No. 7317217-3 and 7317218-1.

Flame smelting in a stationary furnace has also been proposed by Boliden in an earlier application, published as an International Application under No. WO 79/00058. The method according to this earlier application relates to the manufacture of crude iron from material containing sulphidic iron, in which the iron-sulphide material is melted down, using oxygen while adding silica, to form an iron-silicate melt and sulphur dioxide; a reductant is added to the melt to reduce metallic iron to an iron content corresponding to the lowest content required to maintain a low melting point in the system. Any non-iron metals present are bound in the form of a matte, by leaving a certain amount of sulphur in the oxidizing melting process.

Flame-sintering and flame-smelting processes are also applied in another method developed by Boliden for manufacturing crude iron from finely-divided oxidic iron material. This method, which is designated the INRED method, can also be modified to include the manufacture of non-iron metal from sulphidic materials. The method, which is more clearly described in U.S. Pat. No. 4,087,274, employs an oxidizing flame-smelting process in a vortex to enable a counter-flow process to be applied. Those embodiments which relate to the working-up of non-iron metal sulphide concentrates are carried out in a furnace having a smelting shaft which is divided into an upper and a lower zone, of which the upper zone is used as a roasting shaft while the lower zone is primarily used as a smelting shaft, but may also be used for partial reduction purposes. The final reduction is carried out in a reactor vessel which is located beneath and connected to the two-zone shaft and in which a coke bed floats on the slag bath above the layer of reduced metal. The coke reacts with the molten metal oxide and the heat requirement is covered partly by physical heat in the partially molten material and partly by electrical energy. Flame smelting in counterflow, in accordance with the INRED principle, resolves many of the problems previously associated with the flame-smelting of sulphidic non-iron metal materials while recovering non-iron metal. Among other things, as a result of the counterflow principle substantially higher quantities of impurities can be tolerated in the material, since impurities which can be volatilized in sulphidic or metallic form can be immediately separated from the material and accompany the gas charged in counterflow to said material. The method, however, is still encumbered with certain deficiencies, particularly with regard to the working-up of complex sulphide materials containing metals which cannot readily be separated in a metallic state.

The present invention provides a method for selectively recovering the metal content of complex sulphidic metal raw materials, while substantially avoiding these problems, disadvantages or deficiencies encountered in hitherto known flame-smelting methods. In accordance with the method of the invention, the flame-smelting of complex metal-sulphide concentrates is carried out at a high oxygen potential, preferably in a vortex with oxygen-gas or air enriched in oxygen-gas, and optionally while adding return dust and a slag former, such as silica. The flame-smelting process is carried out in a manner to obtain a smelt which is poor in sulphide and which comprises mainly metal-oxide silicate, and optionally a minor percentage of metal phase, primarily comprising metals of a more noble character. The method is characterized by the procedural steps set forth in the accompanying claims.

When flame-smelting said material there is normally reached a temperature of between 1000° and 1400° C., whereat a substantial percentage of the impurities contained by the concentrates, such as arsenic, antimony, cadmium, mercury and other similar elements, can be fumed-off in the form of volatile compounds.

The resultant molten products are collected in a separation zone located beneath the flame-smelting zone. When necessary, supplementary slag formers, generally dolomite and/or limestone, can be supplied to the separation zone through separate lances and injected into the melt with oxygen gas or air enriched in oxygen, in order partly to obtain suitable contents of calcium oxide and magnesium oxide in the metal-oxide-silicate melt, and partly to obtain a desired low sulphur content in the possibly formed metal melt, for example the lead melt, and partly to obtain melts of suitable temperature.

The flame-smelting process can, to advantage, be carried out as a counter-flow process in a vortex, as described in our earlier U.S. Pat. No. 4,087,274, whereat the furnace is modified to, in principle, the furnace embodiment proposed for reducing iron-oxide material, i.e., comprising a flame-smelting shaft which includes only one zone. The underlying reactor vessel for melting and finally reducing the material is also not necessary in this case, and can be replaced by a separation zone, for separating molten silicate and metal.

The method can be carried out in different ways, depending upon the desired end product. As previously inferred, a given quantity of metal phase can be allowed to form, or the formation of such a phase may even be desirable. This is effected by suitable selection of oxygen potential and temperature parameters. The resultant flame-smelted product may also be partially reduced in the furnace, for example by injecting pure sulphide concentrates into the melt, in order to remove noble metals from the silicate phase by reduction. The aforementioned addition of supplementary slag formers may also be made simultaneously with the sulphide charge, thereby providing further possibilities of controlling the end products obtained by the process. For example, when the metal-oxide-silicate melt has a low silicon dioxide content, in the region of 15–25%, it is possible to obtain a high yield of metals such as copper and noble metals, in a molten melt of relatively high sulphur content, namely 1–5%. In those cases when a supplementary slag former, such as limestone, is charged to the melt, it is possible to obtain lower sulphur contents in the molten metal. Thus, in the case of a ratio of $CaO/SiO_2$ of 1.0–2.0 there can be obtained a high yield of copper, nickel and/or noble metals to a metal melt of relatively low sulphur content, namely 0.4–2%. In those cases when the sulphidic starting material contains lead, the formation of a metal-oxide-silicate melt having a high ratio of calcium oxide to silicon dioxide and a lead content of 15–45% is sought for, which enables the effective recovery of copper, nickel, lead and/or noble metals, to leave a resultant crude-metal melt having a low sulphur content, such as a sulphur content in the region of 0.1–0.5%.

By suitably balancing firstly the supply of oxygen-gas and silica to the temperature of the flame-smelting stage, and secondly the percentages of PbO, ZnO, FeO, CaO, MgO, $SiO_2$ and S, together with temperature in the metal-oxide-silicate melt after the flame-smelting stage, there is thus created possibilities of selectively distributing metals between metal phase, metal-oxide-silicate phase and furnace gas from the flame-smelting shaft for different combinations of complex and pure metal sulphide concentrates, while simultaneously eliminating the major part of the sulphur content of said concentrate as sulphur dioxide, via the furnace gas.

The various types of metal melts obtained by the method according to the invention, optionally after being partially reduced, are then refined suitably by means of processes and apparatus adapted to the composition of the metal smelts. In this respect, an injection metallurgical technique, such as that described in our earlier Swedish Patent Application No. SE,A, 7909179-9, can be applied to advantage.

To enable the metals present in the metal-oxide-silicate melt to be recovered more completely, the reductant used is normally coal or coke. In addition hereto a supplementary slag former, normally lime, may also be charged to the system, in order to enhance the reactivity. The metal may be recovered continuously or intermittently, in one or more process stages. Such combinations of processes, reductants and slag formers are selected so that the resultant reduction gas, subsequent to separating dust therefrom, is practically free from sulphur and heavy metals. The recovery of lead, arsenic, antimony, tin, molybdenum and/or cobalt, together with any remaining percentages of copper, noble metals and/or nickel, can be effected, for example, in a Kaldo furnace using coal or coke as a reduction agent, the major part of the energy required herefore being supplied to the process by oxygen-gas combustion of the carbon monoxide gas obtained during the metal reduction process. The reduction of oxidic and similar metal products in a Kaldo furnace is described in more detail in U.S. Pat. Nos. 3,984,235 and 4,017,308. It will be seen from these Patent Specifications that the reduction process in a Kaldo furnace is carried out selectively, so that zinc is not reduced out together with the remaining metals, but remains practically completely together with the major part of the iron content of the slag obtained in the Kaldo furnace. If the slag obtained from the Kaldo furnace contains enough zinc to justify its recovery economically, the zinc can be recovered as a relatively pure zinc-oxide product by slag fuming.

Metal can also be recovered selectively from the metal-oxide-silicate slag by injecting a carbon and a slag former into the metal-oxide-silicate melt, whereat lead, antimony, tin and zinc are vapourized in elementary form and can be recovered in the form of a mixed oxide-dust subsequent to reoxidation. In this way, nickel, copper and other metals, such as cobalt, molybdenum and noble metals can be recovered in the form of a complex metal smelt.

The hot gas from the flame-smelting shaft, said gas having a temperature of from 1000° to 1400° C. and a high sulphur dioxide content, is first shock-cooled, suitably to a temperature of 600°–800° C., by injecting an inert material, such as a silica slag-former into the melt, together with a cold gas which is inert in the present context, for example a sulphur-dioxide gas from which all dust has been removed. In order to avoid the formation of undesirable quantities of sulphur trioxide, antimonates and arsenates, it should be seen that any excess of oxygen is eliminated, by charging a suitable reductant to the system, for example a complex concentrate with pyrite, which enables a sufficiently high partial pressure of sulphur to be achieved in the gas prior to the primary dust separating operation in cyclones and/or in high-temperature dust precipitators at 500° to 600° C. The dust removed in this primary dust-separating operation is returned to the flame-smelting process. After the furnace gas has been oxidized and cooled to the requisite extent, the major part of the arsenic, cadmium, mercury and other volatile elements contained in the metal-sulphide concentrates can be recovered from the gas in dust form, together with varying percentages of lead, zinc, tin, antimony, cadmium, selenium and tellurium in electrical precipitators or dust-filter bags, subsequent to condensation and conditioning in one or more stages.

The method according to the invention can also be carried out to advantage as a flame-smelting process in which a more contaminated fraction of the complex sulphidic metal raw material is flame smelted while only partially oxidizing the sulphide-sulphur content of said material, whereat volatile impurities are dispelled in sulphidic or metallic form, whereupon the partially oxidized residual product is reacted with a flame-smelting product comprising mainly metal-oxide silicate, to form metal and sulphur dioxide, for example substantially in the manner described in our co-application SE,A, No. 8008425 entitled "A Method of Producing Lead from Sulphidic Lead Raw Material".

An embodiment merely selected to exemplify the invention will now be described with reference to the accompanying drawing, the single figure of which illustrates schematically a suitable plant for carrying out the method according to the invention. The illustrated plant, which is intended to operate with fine-grain sulphidic complex non-iron metal concentrate, comprises a shaft 1 for flame-smelting and oxidizing the sulphide concentrate. The lowermost part of the shaft 1 communicates with a separation part 2, in which the products of the flame-smelting process are separated into a silicate phase and possibly a metal phase.

The resultant gas rich in sulphur dioxide and containing a certain amount of dust and products vapourized or gasified from the sulphide silicate charged to the shaft 1, leave the upper part of the shaft through an exhaust line 3, and pass to apparatus 4, 5, 6 in which said gases are purified and the heat content thereof recovered. These last mentioned apparatus comprise a boiler 4, a cyclone apparatus 5 and, for example, a gas-purification means 6 designed for wet-gas purification, from which the purified gases derived of the major part of their heat content leave through a line 7 for recovering the sulphur-dioxide content thereof, for example in the form of a 100% sulphur dioxide or sulphuric acid. At least the upper part of the shaft 1, and also the exhaust line, is constructed of metal tubes through which boiling water is circulated. The exhaust line 3 is suitably provided with means for removing coatings from the tube-covered walls thereof; although, on the other hand, there is endeavoured to provide a protective coating of metal-oxide-silicate material frozen onto the tube-covered walls of the shaft, said walls to advantage being provided with pegs or other forms of projections welded thereonto in order to facilitate freezing of molten material onto the surfaces of said walls. The steam generated in the tubes is separated together with the steam generated in the boiler 4 in the dome 8 of the boiler, from whence the steam is passed through lines 9 and 10 to a steam-utilizing plant (not shown) via a superheater means incorporated in the boiler 4.

Arranged in the roof or ceiling of the shaft 1 is a ring of burners 14, through which finely-divided sulphide concentrate, finely-divided silica and/or other slag formers or fluxing agents, return dust from the boiler 4 and the cyclone means 5, and oxygen-gas or any other gas sustaining the flame-smelting process, such as air or air enriched oxygen-gas, are charged to the shaft 1. In the illustrated embodiment, the burners 14 are supplied with oxygen-gas which is produced in an oxygen-gas producing plant (not shown) and which is charged to the shaft through a line 27. The sulphide concentrate, silica, and other slag formers together with returned dust are stored in bins 19–22, from where they are dispensed in suitable proportions to a mixing and equalizing bin 24, by means of a conveyor belt 23. The material mixture is passed from the bin 24 to the burners 14 via lines 25, 26. The oxygen-gas is charged to the burners 14 via the lines 27 and 28, said line 28 opening out into the line 26.

The burners 14, of which only two are shown in the figure, extend obliquely downwardly tangentially to an imaginary circle at the bottom of the shaft 1. The diameter of the circle should be about one quarter of the diameter of the shaft, and the manner in which the burners are positioned and the extent to which they are inclined is such that the material dispensed therethrough meets the periphery of the circle at regions located symmetrically around said circle. Additional oxygen-gas for the flame-smelting process is supplied to the upper part of the shaft 1 through horizontal nozzles 29, which are supplied from the line 27 via line 30 branching therefrom. The nozzles 29 are directed tangentially to a certain extent, suitably so that the streams of oxygen-gas issuing from said nozzles are tangential to an imaginary circle whose diameter is about one third of the diameter of the shaft.

The sulphide concentrate is melted and oxidized during its passage from the burners 14 down through the shaft 1, and volatile impurities contained in the concentrate are fumed off. The return dust is also melted, and the slag former or formers charge to the system is or are heated. The molten and oxidized sulphide concentrate, together with the heated slag former, i.e. silica, will react during their passage through the shaft to form a metal-oxide-silicate melt, and any metal formed as a result thereof will accompany the melt as such down through the shaft. At the bottom of the shaft the product obtained by flame-smelting in the shaft 1 will collect in the separation part 2, and will there separate into a metal phase and a metal-oxide-silicate phase, said phases being indicated at 38 and 39, and can be withdrawn through respective outlets 31 and 32.

In the boiler 4 and cyclone 5 there is separated a dust comprising mainly metal oxide and metal sulphates. This dust is removed on conveyor belts 35, 36 and is passed by means of arrangements not shown to that one of the bins 19–22 used for storing returned dust. Volatile elements fumed-off during the process, such as selenium, mercury and arsenic together with halogens are caused to pass through the boiler 4 and the cyclone 5 and are individually separated in the gas-purification means 6. The dust obtained in the gas-purification means 6 is carried away through a line 37 for separate treatment.

We claim:

1. A method for recovering the metal content of complex sulphidic metal raw materials by autogenous flame smelting with an oxygen-containing gas, comprising melting said raw materials in a furnace in the presence of an oxygen surplus while adding an acid slag former containing silica to form a melt which is poor in sulphur and comprises mainly metal-oxide silicate; separating from the silicate phase any metal phase formed in the furnace; and recovering non-iron metals present in the silicate phase by selective reduction.

2. The method according to claim 1, wherein said flame-smelting process is carried out in a vortex.

3. The method according to claim 1 or claim 2, wherein said basic slag former is charged directly to the resultant melt rich in metal-oxide silicate prior to said selective reduction.

4. The method according to claim 3, including injecting the basic slag formers through a lance together with a carrier gas containing insufficient oxygen.

5. The method according to claim 1 or claim 2, including partially reducing the metal-oxide silicate formed in the melt, by supplying sulphide material to said melt.

6. The method according to claim 1 or claim 2, including removing the metal-oxide-silicate melt from the furnace subsequent to the separation process, and reducing said melt in one or more stages in at least one further furnace.

7. The method according to claim 6, wherein said last reduction stage is carried out in a slag-fuming furnace.

* * * * *